United States Patent [19]

Tesch

[11] Patent Number: 4,887,325

[45] Date of Patent: Dec. 19, 1989

[54] PATIENT POSITIONING APPARATUS

[76] Inventor: Charles V. Tesch, 2016 Cenwood, Jonesboro, Ark. 72401

[21] Appl. No.: 379,104

[22] Filed: Jul. 13, 1989

[51] Int. Cl.[4] ..... A61G 7/10

[52] U.S. Cl. ..... 5/84; 5/85; 5/89; 24/134 KB; 24/136 L

[58] Field of Search ..... 5/84, 85, 83, 445, 81 R, 5/81 B, 87, 89; 24/134 KB, 136 L

[56] References Cited

U.S. PATENT DOCUMENTS

| | | | |
|---|---|---|---|
| 1,098,477 | 6/1914 | Cashman | 5/89 |
| 1,269,734 | 6/1918 | Noland | 5/84 |
| 1,318,429 | 10/1919 | Young | 5/89 |
| 1,914,171 | 6/1933 | Scmeidegger | 5/84 |
| 2,272,778 | 2/1942 | Reuter | 5/85 |
| 3,612,042 | 10/1971 | Fry | 5/445 |
| 4,194,253 | 3/1980 | Ullven | 5/84 |
| 4,551,872 | 11/1985 | Reed | 5/445 |

*Primary Examiner*—Alexander Grosz
*Attorney, Agent, or Firm*—John J. Mulrooney

[57] ABSTRACT

A Patient Positioning Apparatus comprises a hoist and pulley assembly suspended on a frame above a bed, and connectable through adjustable straps and clamping means to a sling which is positioned under the patient. When the rope connected to the hoist and pulleys is actuated by the patient or a person beside the bed, the patient is moved from either the foot of the bed toward the head of the bed or from the side of the bed toward the center of the bed. A rope gripping means is provided to clamp the rope and suspend the patient in an elevated position above the bed.

5 Claims, 3 Drawing Sheets

PATIENT POSITIONING APPARATUS

BACKGROUND OF THE INVENTION

This invention relates to a patient positioning apparatus, and more particularly to an apparatus which enables bedridden patients or others to easily lift the patient and reposition the patient on or above the bed.

A common occurrence among bedridden patients is that over time the patient moves toward the foot of the bed, and, occasionally, you will find them on one side of the bed. If the patient is relatively heavy or he can only use his upper extremities or is a total invalid, the repositioning or lifting of the patient can pose some difficulty. Such patients are usually moved by hand which necessitates the involvement of two or more persons positioned on each side of the patient to physically raise and reposition the patient. Some devices have been suggested for lifting and/or moving patients, but such devices are complicated and in general inadequate to assure simple mechanical operation thereof and complete comfort and safety to the patient, and the person attending the patient. Also, such prior devices have not been operable by the patient, but have required one or more persons to operate the device in lifting and/or moving the patient. See, for example, the apparatus disclosed in U.S. Pat. Nos. 1,098,477 to Cashman, 1,299,933 to Greene and 1,318,429 to Young.

Therefore, an object of the invention is to provide an improved patient positioning apparatus.

Another object of the invention is to provide an improved patient positioning apparatus designed to enable many patients to reposition themselves in bed without the assistance of other persons.

Another object of the invention is to provide an improved patient positioning apparatus which is simple in construction, yet safe, dependable and convenient to use.

Another object of the invention is provide an improved patient positioning apparatus which may be operated by either the patient or another person.

Another object of the present invention is to provide an improved patient positioning apparatus which enables a patient to be lifted and suspended above a bed.

Another object of the present invention is to provide an improved patient positioning apparatus which enables a patient to be lifted and moved toward the head of the bed.

Another object of the present invention is to provide an improved patient positioning apparatus which enables a patient to be moved toward the center of the bed.

Another object of the present invention is to allow for the use of a patient's existing bed linen in positioning the patient.

SUMMARY OF THE INVENTION

The improved patient positioning apparatus of the present invention comprises an overhead support frame positionable above a bed and extending horizontally along the length of the bed; a hoist positionally mounted along said overhead frame; a plurality of adjustable straps having clamping means at the end thereof for releaseable attachment to a sling which is positioned beneath the patient; a regular pulley and a gripper/pulley positioned to convey said hoist rope to a rope clamp which is capable of immovably griping said hoist rope; said rope clamp is attached to a trapeze grip which is reachable by the patient. When the patient, or another person, pulls on the trapeze grip, the hoist and pulley apparatus function to either move the patient horizontally towards the head of the bed, move the patient laterally towards the center of the bed or lift and sustain the patient vertically off of the bed.

DESCRIPTION OF THE PREFERRED EMBODIMENT

Figures 1, 12:
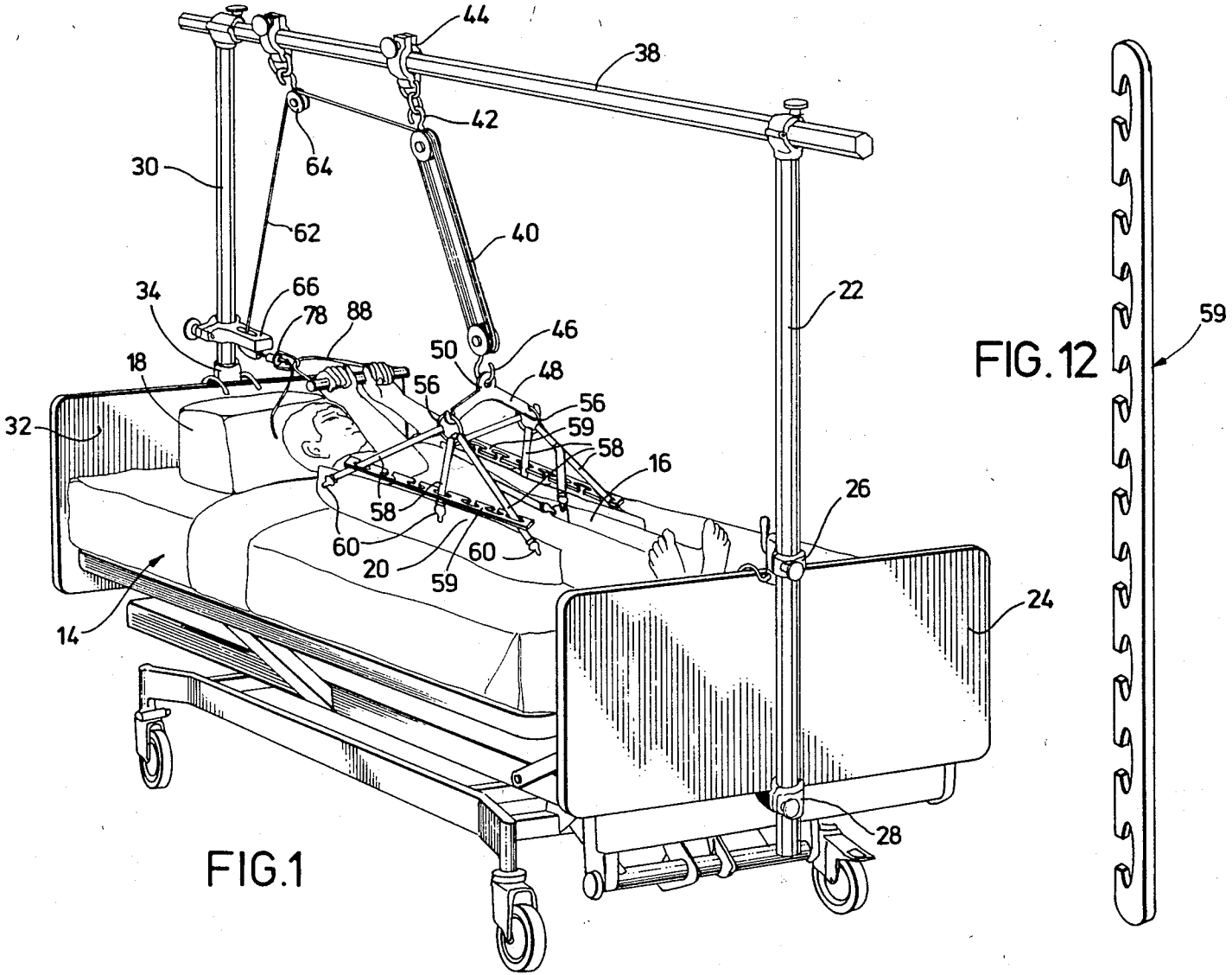
FIG. 1 is a perspective view of a patient in a bed to which the improved patient positioning apparatus of the present invention is connected for movement of the patient.
FIG. 12 is a view of the strap spreader used in this invention.

Referring to the drawings, a bed 14 has a patient 16 reposed thereon. A cushion 18 is provided at the head of the bed for safety as hereinafter described. A sling or draw sheet 20 is positioned between the bedding and the patient. The bed 14 may be the customary design found in hospitals, convalescent and nursing homes, or the type found in private homes. The patient positioning device of the present invention is designed and adaptable to function with beds of all types and designs.

Figure 3:
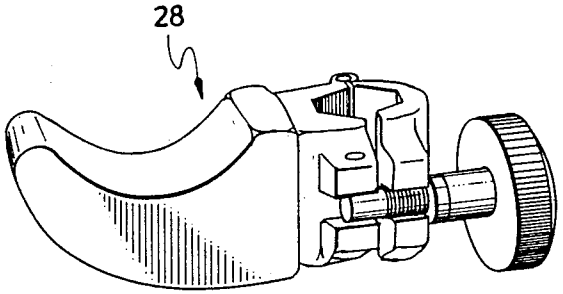
FIG. 3 is an example of a clamping means which may be used to attach the overhead support frame to the lower part of the foot or head panel.
Figure 2:
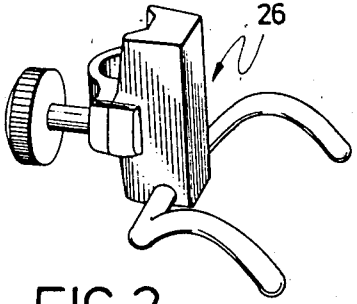
FIG. 2 is an example of a clamping means which may be used to attach the overhead support frame to the upper part of the foot or head panel.

An overhead support frame comprises a first upright support member 22 attached to the foot panel 24 of the bed (by means of upper clamp 26 and lower clamp 28, FIGS. 2 and 3 respectively) and extending upwardly therefrom; a second support member 30 is similarly attached to the head panel 32 of the bed (by means of upper clamp 34 and lower clamp (not shown) FIGS. 2 and 3 respectively) and extending upwardly therefrom; and a horizontal member 38 which extends between vertical support members 22 and 30. The lengths of frame members 22, 30 and 38 are determined by the dimensions of the bed and the determination of a convenient height above the bed. While the overhead frame is illustrated as being fixedly attached to the bed, it is within the contemplation of the invention that the overhead frame may be a freestanding apparatus which may be mounted on a part of its own equipped with rollers for ease of movement between beds prior to attachment to the bed panels. Also, beds of the design commonly found in private homes might require that the overhead frame be a freestanding member.

Figure 4:
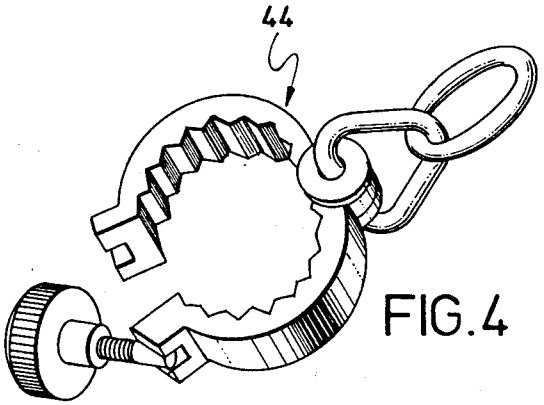
FIG. 4 is an example of clamping and connecting means between the overhead supporting frame and the hoist.
Figure 5:
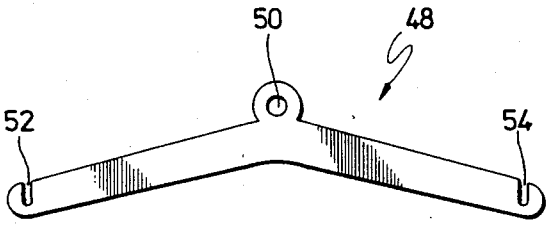
FIG. 5 is an elevation of the spreader bar used in the apparatus of the present invention.

A hoist 40 with sustaining hook 42 above is movably connected to horizontal member 38 by clamping means 44 (FIG. 4); hoist 40 also has customary hook 46 below, which in this invention supports a spreader bar 48 (FIG. 5) by connecting to loop 50. The spreader bar 48 has channel-shaped depressions 52 and 54 at its ends for placement of "O" rings 56 which are in turn connected to a plurality of straps 58 (which are held separate as they pass through strap spreaders 59, FIG. 12) whose lengths are adjustable by any suitable means.

Figure 6:
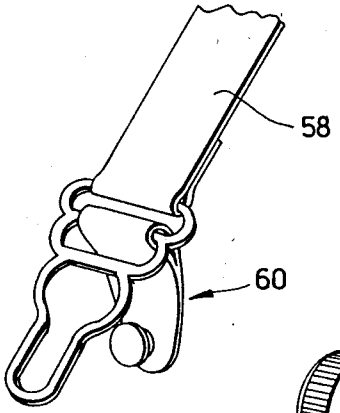
FIG. 6 is an example of a clamp or gripping means which may be used to attach the lifting straps to the sling positioned beneath the patient.

Connecting means 60 at the end of each strap 58 function to quickly, safely and releaseably attach the straps 38 to the sling 20 positioned beneath the patient 16. While many different types of apparatus are useful for the connectors 60 and will be apparent to those skilled in the art, the inventor has found that the fasteners or tabs (FIG. 6) commonly used with garter belts function satisfactorily. The inventor has found that the use of three (3) adjustable straps 58, one of which has two connectors 60 attached, functions satisfactorily. However, it will be appreciated by those skilled in the art that any number of straps which function satisfactorily could be used. As shown in FIG. 1, the connectors 60 are attached to the draw sheet at (with respect to the patient) the crouch area, the buttocks area, the mid-section and the head area.

The spreader bar 48 and strap spreaders 59 function to provide a hammock effect for the sling 20, and also function to prevent the sling from closing on the patient.

Figure 7:
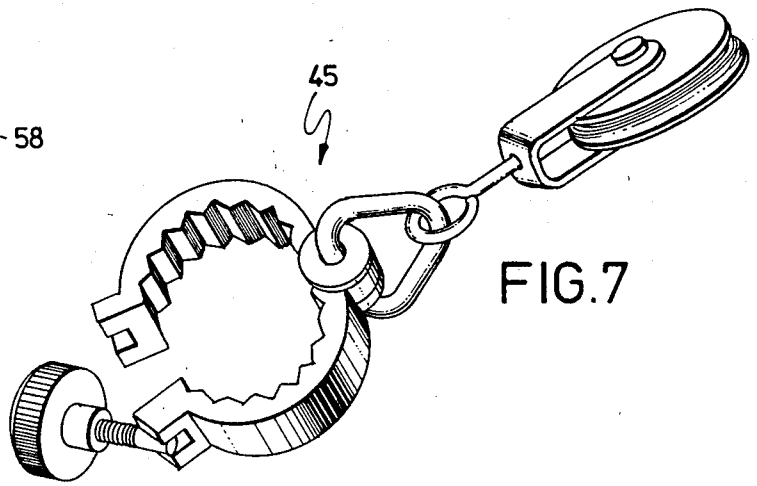
FIG. 7 is an example of a pulley with clamping means to attach it to the overhead support frame used in the apparatus of the present invention.
Figure 11:
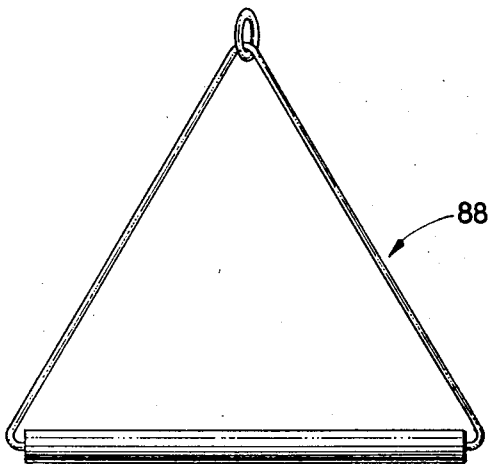
FIG. 11 is a elevation of the trapeze grip used in the apparatus of the present invention.
Figure 8:
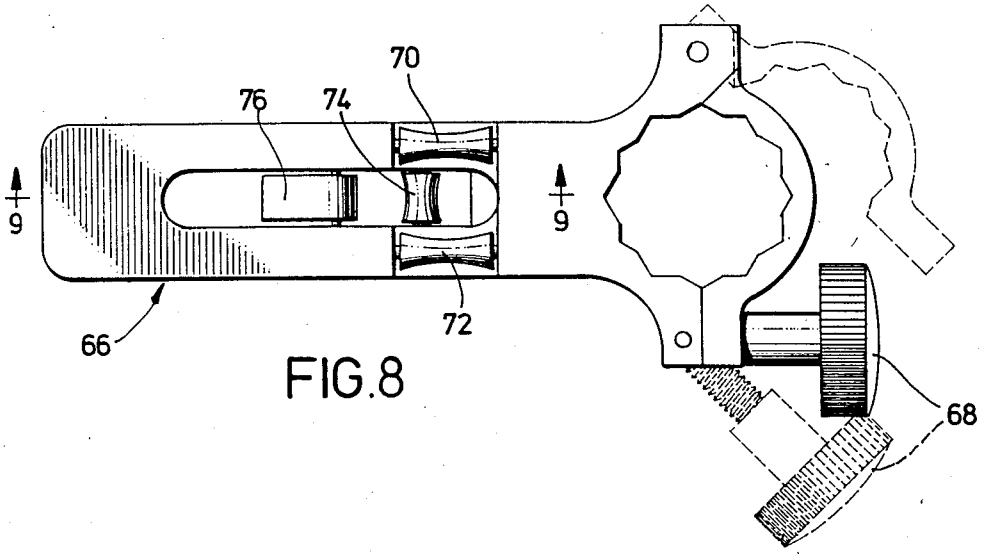
FIG. 8 is a perspective view from above of the gripper/pulley and its clamping means to attach it to the overhead support frame.

The hoist rope 62 is connected through a pulley 64 (FIG. 7), a combination rope gripper/pulley 66 (FIGS. 8 and 9), and a rope gripper 78 (FIG. 10) to a trapeze grip (FIG. 11).

Figure 9:
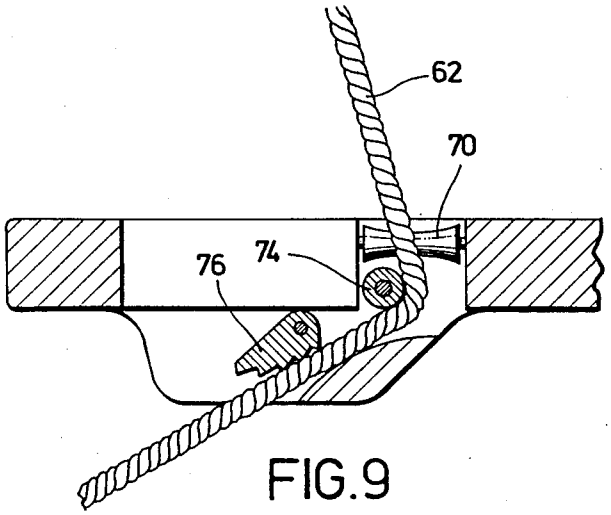
FIG. 9 is a symmetrical sectioned view of the gripper/pulley, with the attaching clamp cut-away, used in the apparatus of the present invention.
Figure 10:
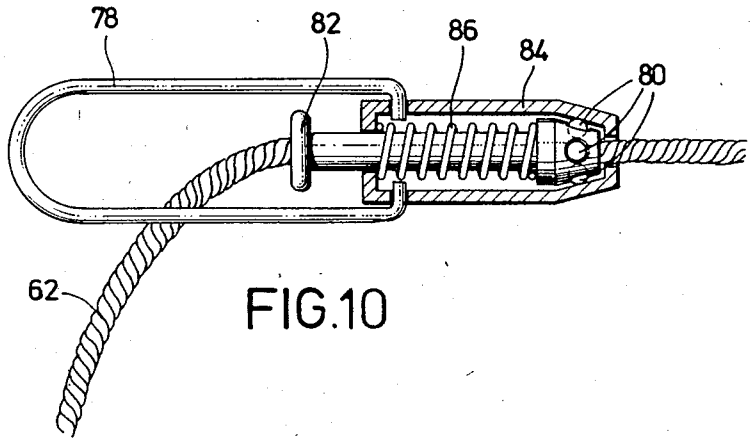
FIG. 10 is a sectional view of the rope gripper used in the apparatus of the present invention.

Connecting means 44, pulley 64 and gripper/pulley 66 are shown mounted to overhead frame member 38 and vertical frame member 30, respectively; however, it will be understood by those skilled in the art that different arrangements for these devices are possible. Likewise, while gripper/pulley 66 is shown attached to member 30 to allow the patient to reposition himself, clamping means 68 (FIG. 8) provides for movable attachment of the gripper/pulley 66 to the upright member 30 so that the angle of pull can allow those standing outside of the bed to actuate the invention. Rollers 70, 72 and 74 ((FIG. 8) provide for smooth movement of the rope 62 regardless of the movably placed direction of pull desired. The gripper/pulley 66 can function to clamp rope 62 when it is desired to maintain the patient in a position elevated off of the bed 14. Teeth or cleats 76 (FIG. 9) function to grip the rope 62 and continue to grip the rope until it is moved down and or away from the teeth 76. The function of the rope gripper 78 (FIG. 10) is to adjust the position of the trapeze grip 88 (FIG. 11) by preventing or allowing movement along the rope 62 when desired. Preventing movement of the rope gripper 78 (FIG. 10) along the rope is caused by the three ball bearings 80 (FIG. 10) being forced against the rope as supporting part 82 (FIG. 10) holds them in place while moving towards the narrow end of the housing 84 (FIG. 10) by the pressure exerted by spring 86 (FIG. 10). Movement is allowed by pulling supporting part 82 (FIG. 10) in a direction away from the narrow end of the housing 84 (FIG. 10) and thereby releasing the pressure of the bearings 80 (FIG. 10) accentuated by the narrowing housing 84 (FIG. 10) and support of the spring 86 (FIG. 10).

In using the apparatus of the present invention, when it is desired to reposition a patient in bed 14 either in a direction toward the head or center of the bed, hoist 40, by means of its attachment to clamp 44 by hook 42, is essentially positioned by attaching clamp 44 above patient's head on horizontal member 38. The connectors 60 are attached to the draw sheet at the positions indicated and the straps 58 are adjusted to create the necessary pulling angle and are held apart by the strap spreaders 59, then either the patient or a person beside the bed may pull on rope 62 by way of trapeze grip 88 which will cause the patient to be moved toward the head or center of the bed. If it is desired to suspend the patient above the bed, the system is next tested to determine whether or not the hoist 40 and connectors 60 are properly located and the traps 58 are properly adjusted with respect to the patient's center of gravity. Then, one simply pulls on the trapeze grip 88 until the patient is at a desired position above the bed because, as previously stated, the teeth 76 (FIG. 9) of the rope gripper pulley 66 automatically sustain the patient above the bed until the rope is moved positionally downward away from the teeth 76 (FIG. 9).

The inventor has found that providing a hoist of sufficient capacity, and having a proper lifting ratio, many patients are able to operate the apparatus by themselves and reposition themselves towards the head or center of the bed; or the repositioning of the patient can be performed by only one person outside the bed.

It can be seen from the foregoing that the present invention provides an improved patient positioning apparatus whereby many patients, or a single attendant, are able to reposition the patient in bed.

What I claim is:

1. Apparatus for repositioning and/or lifting a patient in a bed comprising first and second upright members rigidly secured to the foot and head of said bed;

a horizontal member rigidly secured to the upper ends of said upright members, and extending longitudinally the length of bed;

a hoist attached to said horizontal member by means of a movable clamp;

a spreader bar adapted to be connected to and supported by said hoist, and having means at the ends thereof for receiving and supporting straps;

a plurality of adjustable straps supported at each end of said spreader bar by use of an "O" ring, each said strap also passing through a strap spreader and having connecting means at the other end thereof;

a draw sheet positioned beneath said patient and adapted for connection to said connecting means at the ends of said straps;

a pulley movably attached to said horizontal member positioned to receive a pull rope connected to said hoist;

a rope gripper/pulley attached to said second vertical member and positioned to receive said rope passing through said pulley;

a trapeze grip connected to said hoist rope and positioned to be reachable by said patient, whereby pulling on said trapeze provides a lifting and translating force on the patient which lifts the patient upwards and towards the head or center of the bed.

2. The apparatus defined by claim 1 further comprising a cushion located at the head of the bed.

3. The apparatus defined in claim 1 further comprising a rope gripper positioned between said gripper/pulley and said trapeze for adjusting the length of said hoist rope between said gripper/pulley and said trapeze.

4. The apparatus defined in claim 1 wherein said gripper/pulley can sustain a patient above said bed by use of teeth or cleats.

5. The apparatus defined in claim 1 wherein said gripper/pulley is movably attachable to said upright member and thereby allows one to change the direction of pull thus enabling a person standing beside said bed to cause the patient to be lifted and repositioned therein.

* * * * *